United States Patent [19]

Mann et al.

[11] Patent Number: 4,518,484

[45] Date of Patent: May 21, 1985

[54] METALS REMOVAL WITH A LIGHT HYDROCARBON AND AN ORGANOPHOSPHOROUS COMPOUND

[75] Inventors: David P. Mann; Simon G. Kukes; Daniel M. Coombs, all of Bartlesville, Okla.

[73] Assignee: Phillips Petroleum Company, Bartlesville, Okla.

[21] Appl. No.: 580,997

[22] Filed: Feb. 16, 1984

[51] Int. Cl.[3] ..... C10G 17/02; C10G 21/02

[52] U.S. Cl. ..... 208/87; 208/86; 208/251 R; 208/251 H; 208/252; 208/309; 208/89

[58] Field of Search ..... 208/86, 87, 252, 309, 208/251 R, 251 H, 89

[56] References Cited

U.S. PATENT DOCUMENTS

| | | | |
|---|---|---|---|
| 2,682,496 | 12/1951 | Richardson et al. | 196/50 |
| 2,758,097 | 8/1956 | Doherty et al. | 252/413 |
| 2,919,245 | 12/1959 | Wolfe | 208/252 |
| 2,926,129 | 2/1960 | Kimberlin, Jr. et al. | 208/251 R |
| 2,943,048 | 12/1958 | Rust et al. | 208/252 |
| 2,971,905 | 2/1961 | Bieber et al. | 208/252 |
| 3,036,968 | 5/1962 | Gatsis | 208/251 R |
| 3,202,605 | 8/1965 | Redcay | 208/337 |
| 3,245,902 | 4/1966 | Adams | 208/252 |
| 3,278,415 | 10/1966 | Doberenz et al. | 208/45 |
| 3,507,777 | 4/1970 | Hemminger | 208/86 |
| 3,622,505 | 11/1971 | Tilley et al. | 208/252 |
| 3,647,677 | 3/1972 | Wolff et al. | 208/48 |
| 3,969,196 | 7/1976 | Zosel | 203/49 |
| 4,021,335 | 5/1977 | Beaton | 208/251 R |
| 4,031,002 | 6/1977 | McKay | 208/113 |
| 4,073,719 | 2/1978 | Whisman et al. | 208/180 |
| 4,192,736 | 3/1980 | Kluksdahl | 208/251 |
| 4,290,880 | 9/1981 | Keonard | 208/309 |
| 4,321,128 | 3/1982 | Yoo | 208/114 |
| 4,399,024 | 8/1983 | Fukui et al. | 208/114 |
| 4,419,225 | 12/1983 | Kukes et al. | 208/251 R |
| 4,421,638 | 12/1983 | Nowack et al. | 208/251 R |
| 4,422,926 | 12/1983 | Gould et al. | 208/309 |
| 4,446,006 | 5/1984 | Albertson | 208/251 R |

*Primary Examiner*—Delbert E. Gantz
*Assistant Examiner*—Lance Johnson
*Attorney, Agent, or Firm*—Howard D. Doescher

[57] ABSTRACT

The process described uses a $C_2$-$C_{10}$ hydrocarbon solvent and an organophosphorous compound to extract metals from metal containing oils. Preferably, the extraction is performed above the critical conditions of the solvent.

19 Claims, 1 Drawing Figure

METALS REMOVAL WITH A LIGHT HYDROCARBON AND AN ORGANOPHOSPHOROUS COMPOUND

BACKGROUND

Figure 1:
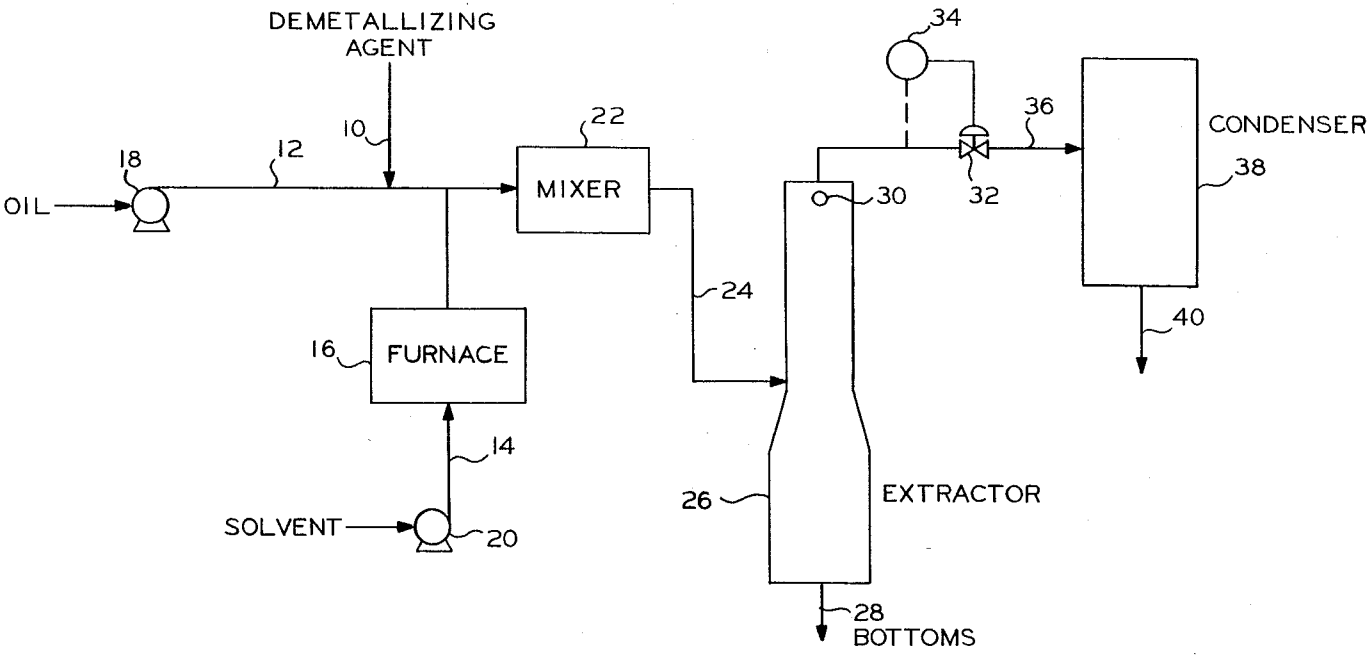

The supply of high API gravity, low metals content crude oils is steadily diminishing. Heavy crudes and other high metals content oils are in greater supply, but they contain higher boiling components and high contaminant levels. Due to the presence of high contents of contaminant metals such as nickel, vanadium, iron and coke-forming carbon materials, catalytic processing of these oils is costly.

THE INVENTION

It has been discovered that high metals content oils can be demetallized and upgraded through a combination of one or more solvent extraction and chemical demetallization operations. In other words, applicants have found that a variety of process schemes, most of which include the use of one or more chemical demetallizing agents during solvent extraction (at subcritical or supercritical temperature and pressure of the solvent) can be used to effectively upgrade heavy, metal-containing hydrocarbon feeds. The products of these processes can be subjected to further refining operations such as hydrodesulfurization, catalytic cracking and the like.

In one embodiment, heavy metals, especially vanadium, are removed from metals-containing heavy crude, such as Monagas, by mixing with an oil-soluble demetallizing agent, such as diphenyl phosphite, then extracting with a hydrocarbon solvent such as n-pentane at or above the critical temperature and pressure of said solvent. Unconverted demetallizing agent can be recovered from the extract by suitable means, e.g., distillation, and recycled in the process.

In another embodiment, heavy oils are demetallized by supercritical extraction with a solvent, e.g., n-pentane, to remove asphaltenes and some metals; followed by heat-soaking of the desolventized extract in the presence of a demetallizing agent, e.g., dimethyl phosphite, and supercritical solvent extraction of the heat-soaked product containing demetallizing agent for further removal of metals.

In another embodiment, the unextracted heavy oil feed and a demetallizing agent, e.g., diphenyl phosphite, are heat-soaked for partial demetallization followed by supercritical extraction in the presence of the demetallizing agent.

In yet another embodiment, heavy oils are refined by a process which comprises:

(a) chemical demetallization, preferably with organic or inorganic phosphorous compounds during supercritical extraction, and (b) catalytic cracking of the desolventized oil extract without prior removal of residual phosphorus compounds.

In still another embodiment, chemical demetallization and supercritical extraction can be carried out simultaneously, with recycle of a fraction of the bottoms product from the extraction zone to the feed oil stream. Additionally, the asphalt stream from the separation zone can be stripped of demetallizing agent and the demetallizing agent can be recycled.

In still another embodiment, supercritical extraction is carried out with a paraffinic hydrocarbon solvent in the presence of chemical demetallizing agent, e.g., aliphatic or aromatic phosphites or phosphates, or phosphoric acid, and a portion of the asphalt-containing extraction bottoms is recycled for greater utilization of the demetallizing agent. The unrecycled bottoms portion can then be stripped for recovery of entrained demetallizing agent, and the stripped bottoms portion is oxidized to produce primarily CO and $H_2$.

In other embodiments, concurrent supercritical extraction and demetallization is carried out using one or both of aqueous hydrogen halides (e.g., an aqueous solution containing 0.01 to 10 weight percent hydrogen fluoride) or a methylating agent such as dimethylsulfate as the demetallizing agent.

When using any of these demetallizing agents, i.e., phosphorus compounds, dimethylsulfate, or HF, the demetallizing agent can be added at at least one of three points: to the solvent stream, to the extraction column at a point above the oil feed entry, or to the oil feed stream.

In one variation of each of these embodiments, the extraction can be carried out at subcritical solvent conditions instead of supercritical conditions. In these variations only, solvent would be recovered by a phase change operation: distillation, flashing, etc. Of the two methods of extraction, supercritical extraction is presently preferred.

OBJECTS OF THE INVENTION

It is one object of the invention to provide a process for the demetallization and upgrading of high metals content oils.

It is another object of the invention to provide a process by which high metals content oils can be upgraded via a process involving supercritical or subcritical solvent extraction and chemical demetallization.

ADVANTAGES

The processes of the invention have several advantages over known processes for upgrading high metals content oils to yield hydrocarbon values. In using the process of the invention, efficient demetallization is carried out, while high product recovery is realized. Furthermore, in those operations which involve recycling steps, the techniques are highly cost effective. In addition, it has been found that the feed/extractant mixture is more easily produced in the presence of certain demetallizing agents.

In addition, it has been found that injecting the phosphorous demetallizing agent into the feed can reduce its viscosity. The addition of such an agent at an early stage of the process can make the feed easier to pump through field and/or process pipelines. Further, if unreacted agent is allowed to remain in the extract, the apparent viscosity of this product oil can also be reduced.

Other objects and advantages of the invention will become apparent upon reading applicants' specification and claims.

DESCRIPTION OF THE INVENTION

Carbonaceous Feeds

The carbonaceous feeds to be processed in accordance with the invention are high metals content feedstocks. They are generally hydrocarbon-based materials whose solvent extracts can be readily upgraded to yield useful hydrocarbon products, such as fuels and lubricants, via conventional refining techniques.

Typical carbonaceous feeds to be employed herein include resids and crudes from various geographical regions. Preferred feeds are heavy oils and resids bearing such designations as: Monagas crude, Canadian heavy oil, Californian heavy oil, Mexican heavy oil, Middle Eastern heavy oil, and the like. Mixtures of feedstocks as crudes, atmospheric resids or vacuum resids, can be employed.

While the metals content of the initial carbonaceous feed can vary within wide limits, the inventive processes are highly effective when the feed employed has a metals content of 100 parts per million by weight or higher. Feeds having metal contents of 200 parts per million to 1500 parts per million are preferred.

Other ways of characterizing the carbonaceous feeds to be employed herein are API gravity and carbon residue. Typically, the feeds have an API gravity at 60° F. of 2–20 and contain from 8 to 38 percent Ramsbottom carbon residue. Preferred ranges are 5–15 API and 10 to 30 percent carbon residue.

Solvent Extraction

The critical temperature of a material, e.g., a solvent, is the temperature above which it cannot be liquefied or condensed via pressure changes. A material's critical pressure is the pressure required to maintain the liquid state at the critical temperature. The preferred solvents employed in the instant invention are those whose critical parameters render them suitable for conventional supercritical extraction operations when they are under supercritical conditions, i.e., at or above the critical temperature and/or pressure of the solvent(s).

Generally, solvents useful in the extraction operations of the invention are hydrocarbon compounds containing from about 2 to about 10 carbon atoms per molecule. Typical solvents include saturated cyclic or acyclic hydrocarbons containing about 3 to about 8 carbon atoms, and the like, and mixtures thereof. Preferred solvents include $C_4$ to $C_7$ paraffins and mixtures thereof. Highly preferred solvents are n-butane, isobutane, n-pentane, branched pentanes, n-hexane, branched hexanes, n-heptane, and branched heptanes.

Various considerations, such as economics and apparatus limitations, will have bearing on the parameters under which extraction takes place. Furthermore, routine experimentation by the skilled artisan will yield optimum parameters for a given situation. With this in mind, the following tabulation should be read as merely suggestive, and not limiting, in carrying out processes based on the instant invention. The following extraction variables are suggested:

| Variable | Broad Range | Preferred Range |
|---|---|---|
| Temperature, °F. | 200–900 | 300–650 |
| Solvent: Oil Weight Ratio | 1:1 to 10:1 | 2:1 to 5:1 |
| Pressure, psig | 200–2,000 | 500–1,000 |
| Residence time, minutes | 0.5–60 | 1–20 |
| Extract: residue weight ratio | 1:1 to 12:1 | 2:1 to 9:1 |

Conventional recovery and processing techniques, such as desulfurization, hydrotreating, and catalytic cracking, can be employed in combination with the extraction and demetallization techniques discussed herein.

Commercially, solvent can be recovered in an energy-efficient manner by reducing the solubility of the extract oil in the supercritical solvent. This is done by decreasing the pressure and/or increasing the temperature of the oil-solvent mixture.

Demetallizing Agents

The chemical demetallizers employed in the invention are any reagents or combination of reagents known to assist in the removal of metal contaminants from the carbonaceous feeds treated herein. Generally, they are phosphorus-, sulfur-, and halogen-containing compounds known for their capacity to assist in such separation. Mixtures of demetallizing agents are operable.

One useful class of demetallizing compounds are organic and inorganic phosphorus compounds. Useful inorganic phosphorus compounds include phosphine, phosphorus sulfides, and phosphoric acid, with phosphoric acid preferred.

The organic phosphorus compounds employed in the present invention are selected from the group consisting of hydrocarbylphosphines, hydrocarbyl phosphites, hydrocarbyl phosphonates, hydrocarbyl phosphates, hydrocarbylphosphine oxides, hydrocarbyl thiophosphites, hydrocarbyl thiophosphates, hydrocarbylphosphine sulfides, and mixtures thereof.

Any suitable hydrocarbylphosphines can be used in the practice of the invention. Suitable hydrocarbylphosphines are generally characterized by formula 1.

(1) $R_xPH_{3-x}$ where x is 1, 2 or 3.

Suitable hydrocarbylphosphines include ethylphosphine, dipropylphosphine, tri-n-butylphosphine, triphenylphosphine, and n-hexyldiphenylphosphine.

Any suitable hydrocarbyl phosphites can be used in the practice of the invention. Suitable hydrocarbyl phosphites are generally characterized by formulas 2 and 3.

(2) $(RO)_xP(O)H(OH)_{2-x}$ (3) $(RO)_3P$ where x is 1 or 2.

Suitable hydrocarbyl phosphites include dimethyl phosphite, diethyl phosphite, diphenyl phosphite, trimethyl phosphite, triethyl phosphite and triphenyl phosphite.

Any suitable hydrocarbyl phosphonate can be used in the practice of this invention. Suitable hydrocarbyl phosphonates are generally characterized by formula 4.

(4) $(RO)_xP(O)R(OH)_{2-x}$ where x is 1 or 2.

Suitable hydrocarbyl phosphonates include dimethylethyl phosphonate, dimethylbutyl phosphonate, and dimethylphenyl phosphonate.

Any suitable hydrocarbyl phosphates can be used in the practice of the invention. Suitable hydrocarbyl phosphates are generally characterized by formula 5.

(5) $(RO)_xPO(OH)_{3-x}$ where x is 1, 2 or 3.

Suitable hydrocarbyl phosphates include methyl phosphate, ethyl phosphate, dimethyl phosphate, diethyl phosphate, trimethyl phosphate, triethyl phosphate and triphenyl phosphate. Preferred are compounds with x=3.

Any suitable hydrocarbylphosphine oxides can be used in the practice of the invention. Suitable hydrocarbylphosphine oxides are generally characterized by formula 6.

(6) $R_xP(O)H_{3-x}$ where x is 1, 2 or 3.

Suitable hydrocarbylphosphine oxides include dimethylphosphine oxide, diethylphosphine oxide, diphenylphosphine oxide, trimethylphosphine oxide, triethylphosphine oxide and triphenylphosphine oxide.

Any suitable hydrocarbyl thiophosphites and thiophosphates can be used in the practice of the invention.

Suitable hydrocarbyl thiophosphites and thiophosphates are generally those characterized by formulas 7 and 8, respectively.

(7) $(RO)_2P(S)H$ (8) $(RO)_3PS$

Suitable hydrocarbyl thiophosphites include dimethyl thiophosphite, diethyl thiophosphite, diphenyl thiophosphite. Suitable hydrocarbyl phosphates include trimethyl thiophosphate, triethyl thiophosphate and triphenyl thiophosphate.

Any suitable hydrocarbylphosphine sulfides can be used in the practice of the invention. Suitable hydrocarbylphosphine sulfides are generally characterized by formula 9.

(9) $R_xP(S)H_{3-x}$ where x is 1, 2 or 3.

Suitable hydrocarbylphosphine sulfides include trimethylphosphine sulfide, triethylphosphine sulfide, triphenylphosphine sulfide, dimethylphosphine sulfide, diethylphosphine sulfide and diphenylphosphine sulfide.

For formulas 1 through 9, R can be alkyl, cycloalkyl or aryl and can contain from 1 to 12 carbon atoms. Preferably the hydrocarbyl substituents will contain 6 or less carbon atoms with the methyl group being most preferred because the methyl group shields the phosphorus atom least and methyl compounds are generally least expensive.

Presently the most preferred organic phosphorus compounds include trimethyl phosphate, triethyl phosphate, diphenyl phosphite, trimethyl phosphite, dimethyl phosphite, and the like, and mixtures thereof.

Another useful class of compounds are sulfur-containing compounds bearing organic substituents. Generally, hydrocarbyl sulfates and hydrocarbyl sulfites bearing $C_1$ to $C_7$ hydrocarbyl substituents are employed. Preferred compounds include dimethyl sulfite, dimethyl sulfate, diethyl sulfate, isopropyl sulfate, and the like, with dimethyl sulfate preferred.

Another useful class of demetallizing agents are hydrogen halides. Generally, hydrogen chloride and hydrogen fluoride mixed in suitable proportions in aqueous solution containing HCl or HF in the range of about 1 to about 50 weight percent, with 20 to 40 weight percent preferred. One preferred reagent is an aqueous HF solution containing 20 to 40 weight percent HF. Mixtures of hydrogen halides can be employed.

When a chemical demetallizing agent is employed, it is usually used at an agent to oil weight ratio ranging from about 0.0005:1 to about 0.4:1, preferably about 0.005:1 to about 0.1:1.

As was pointed out earlier, applicants contemplate the addition of demetallizing agents at various points during the total extraction/demetallization scheme. Thus, the demetallizing agent may be added to the solvent, to the oil feed, or to the extraction zone at a point above the feed entry point.

The heat-soaking technique employed in one embodiment herein can be characterized as premixing oil and demetallizing agent and heating the solution in a furnace at a temperature of about 500°-700° F. for about 10-60 minutes, optionally in the presence of hydrogen. Conventional heat soaking can be carried out before, during, or after single- or multiple-extraction processes.

In one of the aspects of the invention, catalytic cracking of the extraction product without prior hydrotreatment is employed. Hydrodesulfurization can be carried out before, during or after catalytic cracking at any point in the overall process. Preferably, the extract(s) are subjected to hydrodesulfurization and subsequent cracking.

A better understanding of the invention can be attained from a consideration of the following examples and the accompanying drawing.

EXAMPLES AND DRAWING

The drawing shows a typical upgrading process. It is described in Example I.

EXAMPLE I

All experimental runs were carried out essentially in accordance with the following procedure. A heavy oil feed was preheated, generally to about 250°-330° F., by means of a steam-traced feed tank and electric heating tapes wrapped around stainless steel feed lines (inner diameter: about ¼"). As indicated in the drawing, in runs employing a chemical demetallizing agent, said agent (10) (being at room temperature) was added to the hot oil feed stream (12) at a point several feet before it joined with the solvent feed line. The entire n-pentane or n-heptane solvent stream (14) was preheated in a split-type tubular furnace (16) (Mellen Company, Pennacock, N.H.; Series 1)operating at a temperature of about 400°-500° F. The solvent and oil streams were then pumped by means of two Whitey Corp. (Highland Heights, Ohio) positive displacement diaphragm-sealed pump (18), (20) through the furnace and into a static mixer (22), which was about 3 inches long and had an inner diameter of about ⅜ inch.

The solvent-oil mixture (24) was charged to a vertical stainless steel extractor (26) (without packing or baffles), which consisted of a bottom pipe section having a length of about 11 inches and an inner diameter of about 1.69 inches, a 2 inch long reducer section and an upper pipe section of 27 inches length and 1.34 inches inner diameter. The charge point of the oil-solvent feed (24) was about 2 inches above the reducer. If desired, the bottoms product could be withdrawn through line (28).

The entire extractor was wrapped with electrical heating tape and was well insulated. The temperature in the extractor was measured in 4 locations by means of thermocouples inserted through thermocouple fittings and extending into the center of the extraction column. The temperature at the top of the extractor (point 30) was considered the most important temperature parameter and is listed in tables of subsequent examples as "extraction temperature". The temperature at point 30 was higher than the temperature at any other poiint inside the extractor.

The pressure in the extractor was regulated by means of a motor valve (32) with interfaced pressure controller (34) in the exit line (36). For simplicity of these examples, the depressurized extract was condensed in a water-chilled condenser (38) and was passed through line (40) into a collector flask (not shown in the Figure). Samples of the extract were distilled in a nitrogen atmosphere so as to separate the solvent (n-pentane or n-heptane) from the extract oil, which was then analyzed. Vanadium and phosphorus contents were determined by plasma emission analysis; the nickel content was determined by plasma emission or atomic absorption analysis.

EXAMPLE II

This example illustrates the supercritical extraction of Monagas (Venezuela) crude residuum (boiling range: 650+° F.; containing about 120 ppm nickel, about 480 ppm vanadium, about 0.56 weight percent nitrogen, about 3.6 weight percent sulfur, having a Ramsbottom carbon residue of about 14.9 weight percent and an API gravity at 60° F. of 7.3) employing n-pentane (Runs 1–16) or n-heptane (Runs 17–20) as solvents at an extractor pressure of about 800 psig. Pertinent process conditions and properties of desolventized extract oils obtained at comparable solvent:oil weight ratios (about 3.6–4.8) and extract oil yields (about 60–80 weight percent) for representative runs, with and without phsphorus compounds as chemical demetallizing agents, are summarized in table I. In Runs 1–14, oil plus chemical agent (if used) and n-pentane were preheated and then mixed at a temperature of about 390°–410° F. In Runs 15–16, oil and chemical demetallization agent were first passed through a furnace operated at 500° F. with a residence time of 40 minutes and then mixed with the solvent at 390°–410° F. In Runs 17–20, n-heptane was employed as the solvent. Oil, n-heptane and chemical agent (if used) were mixed at a temperature of 540°–565° F. before being charged to the reactor. At an extractor pressure of about 800 psig in all runs and at the temperatures listed in Table I, the calculated pure component solvent density was about 21–26 lb/ft$^3$.

TABLE I

| Run | Demetal. Agent | Agent to Oil Wt Ratio | Extr. Temp. (°F.) | Flow Rate (g/hr) Oil | Flow Rate (g/hr) Solvent | Solvent to Oil Ratio | Extract Oil Yield (Wt %) of Feed Oil | Extract Oil Properties Rams. C (Wt %) | API (60° F.) | ppm P | ppm Ni | ppm V | % Removal[6] of Ni + V |
|---|---|---|---|---|---|---|---|---|---|---|---|---|---|
| 1 (Control) | — | 0 | 405 | 100 | 412 | 4.12 | 67 | 4.0 | — | — | 18 | 64 | 90.8 |
| 2 (Control) | — | 0 | 404 | 96 | 401 | 4.18 | 70 | 4.1 | — | — | 18 | 63 | 90.6 |
| 3 (Control) | — | 0 | 406 | 145 | 702 | 4.84 | 77 | 4.3 | 14 | — | 19.7 | 66.6 | 88.9 |
| 4 (Control) | — | 0 | 425 | 155 | 672 | 4.34 | 80 | 5.5 | 11.3 | — | 25.3 | 92 | 84.4 |
| 5 (Invention) | TMPate[1] | 0.020 | 425 | 140 | 665 | 4.75 | 72 | 3.6 | 13.6 | — | 18.2 | 56.1 | 91.1 |
| 6 (Invention) | TMPate[1] | 0.020 | 405 | 151 | 653 | 4.32 | 69 | 4.2 | 13.2 | — | 21.8 | 70.6 | 89.4 |
| 7 (Invention) | TMPate[1] | 0.19 | 405 | 101 | 403 | 3.99 | 81 | 6.1 | 12.4 | 5190 | 26.4 | 56.8 | 88.8 |
| 8 (Invention) | TMPate[1] | 0.28 | 410 | 105 | 405 | 3.86 | 74 | 4.8 | 13 | 4160 | 21 | 57.8 | 90.3 |
| 9 (Invention) | TMPate[1] | 0.29 | 410 | 105 | 402 | 3.83 | 63 | 4.7 | 13.3 | 2550 | 19.1 | 15.3 | 96.4 |
| 18[5] (Invention) | TMPate[1] | 0.38 | 560 | 102 | 410 | 4.02 | 86 | 9.0 | 11.1 | 2540 | 41.3 | 11.3 | 92.5 |
| 19[5] (Invention) | TMPate[1] | 0.12 | 570 | 95 | 380 | 4.00 | 82 | 6.5 | 12.2 | 616 | 32.8 | 27.6 | 91.8 |
| 20[5] (Invention) | TMPate[1] | 0.29 | 580 | 92 | 395 | 4.29 | 69 | 4.5 | 13.5 | 625 | 21.1 | 3.5 | 97.2 |
| 10 (Invention) | TMPate[1] | 0.34 | 420 | 93 | 401 | 4.31 | 67 | 3.5 | 14.4 | 1990 | 14.9 | 14.1 | 97.9 |
| 11 (Invention) | TMPate[1] | 0.39 | 410 | 107 | 415 | 3.88 | 76 | 5.0 | 12.7 | 1690 | 21.9 | 23.8 | 94.2 |
| 12 (Invention) | TEPate[2] | 0.26 | 410 | 108 | 410 | 3.80 | 78 | 4.1 | 10.8 | 1460 | 9.3 | 4.4 | 98.2 |
| 13 (Invention) | DPPite[3] | 0.020 | 404 | 150 | 700 | 4.67 | 69 | 4.6 | 13.3 | 3180 | 18.3 | 20.2 | 95.6 |
| 14 (Invention) | DPPite[3] | 0.037 | 405 | 110 | 396 | 3.60 | 61 | 3.8 | 13.3 | 2420 | 15.4 | 20 | 96.4 |
| 15[4] (Invention) | DPPite[3] | 0.006 | 420 | 105 | 390 | 3.71 | 61 | 3.1 | 14.1 | 41 | 14.2 | 46.9 | 93.8 |
| 16[4] (Invention) | DPPite[3] | 0.038 | 405 | 110 | 391 | 3.55 | 63 | 4.0 | 13.5 | 194 | 16.9 | 57.2 | 92.2 |
| 17[5] (Control) | | 0 | 572 | — | — | 4.0 | 77.1 | 6.7 | 13.0 | — | 16.8 | 136 | 80.4 |

[1]Trimethyl phosphate, marketed by Aldrich Chemical Company, Milwaukee, Wisconsin
[2]Triethyl phosphate, marketed by Aldrich Chemical Company, Milwaukee, Wisconsin
[3]Diphenyl phosphite, marketed by Aldrich Chemical Company, Milwaukee, Wisconsin
[4]Oil and demetallizing agent were premixed and then passed through a furnace at 500° F. with a residence time of about 40 minutes;
[5]n-Heptane was used as solvent; demetallizing agent was added to oil at about 300° F. shortly before mixing with n-heptane. The temperature of the oil-solvent-chemical mixture was maintained at about 540–565° F. before it was charged to the extractor.
[6]$\% \text{ Removal of Ni} + \text{V} = 100 - \frac{(\text{Extract Oil Yield}) \times (\text{ppm of Ni} + \text{V in Extract Oil})}{\text{ppm of Ni} + \text{V in Feed Oil}}$ Data in Table I show that, at comparable process conditions and essentially the same extract yields, the removal of nickel and vanadium by supercritical extractions with n-pentane and n-heptane at 800 psig was greater when organophosphorus demetallizing agents were present (compare Runs 1 and 10; 2 and 13; 3, 11 and 12; 4 and 7). Comparing runs 1 to 10, 2 to 13, 3 to 11 and 12, and 4 to 7 shows that organophosphorus agents improved demetallization from an average of 88.7 percent removal to 95.5 percent removal for an average extract product yield of 74 percent.

Data in Table I also show that in invention runs the nitrogen-stripped (desolventized) extract oil contained considerable amounts of phosphorus (which might be removed before subsequent processing of the oil). Heat soaking of oil feed and chemical demetallizing agent at 500° F. (runs 15, 16) did not result in a significant, consistent improvement versus runs without this step (runs 5–14).

In Runs 17–20, another aliphatic solvent (extractant), n-heptane, was successfully employed for the demetallization of the oil, at a higher extract temperature of about 570° F., as compared with about 410° F. for n-pentane. The presence of a demetallizing agent also resulted in higher removal of Ni and V (compare Run 17 with Runs 18–20). Averages for invention runs are 93.8 percent removal of Ni+V at 79 percent extract yield while the control run established 80.4 percent removal of Ni+V at 77.1 percent extract yield as a base line.

EXAMPLE III

This example illustrates the supercritical extraction of Monagas crude residuum (see Example II) at an extraction column pressure of 950 psig., with n-pentane as the solvent. Solvent and oil were mixed and preheated at a temperature of about 350°–400° F. before being charged to the extractor (extraction column). Pertinent process conditions and properties of the desolventized (stripped) extract oil are summarized in Table II. The solvent density at about 950 psig and the temperatures listed in Table II was calculated to be about 25–26 lb/ft$^3$.

invention runs 23–32; 86.1 percent removal of Ni+V, at an extract yield of 79.1 percent.

Notice that an increase in extract yield results in a decrease in Ni+V removal for the control runs. The invention runs demonstrate that phosphorus demetallizing agents can be used to obtain higher yields at the same or higher levels of metals removal than that for lower yields produced without demetallizing agents. Run 29 demonstrates that an inorganic phosphorus compound, $H_3PO_4$, was effective as a demetallizing agent during supercritical extraction with n-pentane at 950 psig.

EXAMPLE IV

This example illustrates a simulated two-stage supercritical heavy oil extraction process using a Monagas feed. The desolventized extract from a first supercritical extraction stage (pressure: 900 psig; extract exit temperature: 415° F.; solvent to oil weight ratio; 4.8; 75 percent of the solvent flowed countercurrently to oil, i.e., the extract was procued in a pilot plant unit in which 75 percent of the total solvent flow was introduced near

TABLE II

| Run | Demetal. Agent | Agent to Oil Wt Ratio | Extr. Temp. (°F.) | Flow Rate (g/hr) Oil | Flow Rate (g/hr) Solvent | Solvent to Oil Ratio | Extract Oil Yield (Wt %) | Extract Oil Properties Rams. C (Wt %) | API (60° F.) | ppm P | ppm NI | ppm V | % Removal of Ni + V |
|---|---|---|---|---|---|---|---|---|---|---|---|---|---|
| 21 (Control) | — | 0 | 400 | 97 | 407 | 4.20 | 75 | 5.1 | — | — | 25.1 | 94 | 85.1 |
| 22 (Control) | — | 0 | 395 | 100 | 410 | 4.10 | 80 | 6.0 | — | — | 29.4 | 118 | 80.4 |
| 23 (Invention) | TMPate[3] | 0.020 | 400 | 153 | 760 | 4.61 | 81 | 6.4 | 12.8 | — | 28.7 | 98.2 | 82.9 |
| 24 (Invention) | TMPate[3] | 0.020 | 404 | 153 | 700 | 4.58 | 75 | 4.9 | 12.7 | — | 25.4 | 85.9 | 86.1 |
| 25 (Invention) | TMPate[3] | 0.020 | 395 | 218 | 718 | 3.29 | 78 | 6.5 | 11.9 | 1770 | 28 | 113 | 81.7 |
| 26 (Invention) | TMPate[3] | 0.020 | 405 | 246 | 732 | 2.98 | 77 | 5.5 | 12.1 | — | 22.6 | 115 | 82.4 |
| 27[1] (Invention) | TMPite[4] | 0.105 | 400 | 100 | 415 | 4.15 | 78 | 5.9 | — | 829 | 36.1 | 54 | 88.3 |
| 28[1] (Invention) | TMPite[4] | 0.101 | 400 | 100 | 392 | 3.92 | 79 | 4.6 | — | 639 | 35.2 | 54 | 88.3 |
| 29[2] (Invention) | $H_3PO_4$ | 0.162 | 400 | 104 | 423 | 4.07 | 78 | 5.4 | — | 142 | 45.6 | 75 | 84.3 |
| 30 (Invention) | DMPite[5] | 0.026 | 395 | 91 | 397 | 4.36 | 76 | 5.8 | — | 1580 | 32 | 64 | 87.8 |
| 31 (Invention) | DMPite[5] | 0.13 | 395 | 100 | 398 | 3.98 | 83 | 6.2 | — | — | 35 | 49 | 88.4 |
| 32 (Invention) | DMPite[5] | 0.26 | 395 | 96 | 417 | 4.34 | 86 | 6.5 | — | 4270 | 39 | 24 | 91.0 |

[1]oil and demetallizing agent were premixed and then passed through a furnace at 600° F.
[2]oil and demetallizing agent were premixed and then passed through a furnace at 550° F.
[3]trimethyl phosphate
[4]trimethyl phosphite
[5]dimethyl phosphite Data in Table II (pressure: 950 psig) confirm the results obtained at 800 psig, namely a higher degree of metals removal from Monagas feed oil is obtained at a given yield, when phosphorus-containing demetallizing agents are present during the supercritical extraction. (Compare Runs 21, 24 and 30; 22, 23 and 28). Averages of control runs 21 and 22: 82.7 percent removal of Ni+V, at an extract yield of 77.5 percent. Average of the bottom of the extractor; extract yield: 86.7 wt. percent) was used in all runs as the feed for the second extraction stage employing n-pentane at pressures of 900 psig and 950 psig. Process conditions of extraction results of the second stage are summarized in Table III; reported extract yields are total yields of both stages and were calculated by multiplying the second stage yield by 0.867 (first stage yield). The chemical demetallizing agent employed in invention runs was dimethyl phosphite (DMPite).

TABLE III

| Run | DMPite:Oil Wt Ratio | Pressure (Psig) | Extract Temp. (°F.) | Flow Rate (g/hr) Oil | Flow Rate (g/hr) Solvent | Solvent to oil Weight Ratio | Extract Oil Yield (Wt %) | Extract Oil Properties Rams. C (Wt %) | Extract Oil Properties ppm P | Extract Oil Properties ppm Ni | Extract Oil Properties ppm V | % Removal of ni + V |
|---|---|---|---|---|---|---|---|---|---|---|---|---|
| 33 (Control) | 0 | 900 | 410 | 105 | 406 | 3.87 | 69 | 4.4 | 161 | 22 | 77 | 88.6 |
| 34 (Control) | 0 | 900 | 420 | 101 | 410 | 4.06 | 56 | 3.2 | 108 | 16 | 53 | 93.5 |
| 35 (Control) | 0 | 900 | 401 | 103 | 394 | 3.83 | 72 | 5.1 | 20 | 26 | 85 | 85.9 |
| 36 (Invention) | 0.022 | 900 | 400 | 108 | 408 | 3.78 | 75 | 5.3 | 1710 | 23 | 27 | 93.7 |
| 37 (Invention) | 0.063 | 900 | 405 | 95 | 403 | 4.24 | 74 | 5.0 | 2612 | 25 | 28 | 92.4 |
| 38 (Invention) | 0.15 | 900 | 400 | 82 | 395 | 4.82 | 79 | 5.4 | 7900 | 21 | 11 | 95.8 |
| 39 (Invention) | 0.24 | 900 | 405 | 99 | 400 | 4.04 | 79 | 5.5 | 3890 | 30 | 20 | 93.4 |
| 40 (Control) | 0 | 950 | 395 | 105 | 390 | 3.71 | 79 | 5.9 | 377 | 35 | 108 | 80.4 |
| 41 (Invention) | 0.022 | 950 | 395 | 110 | 397 | 3.61 | 76 | 6.1 | 1510 | 30 | 66 | 87.8 |
| 42 (Invention) | 0.071 | 950 | 395 | 85 | 420 | 4.94 | 83 | 6.2 | 7190 | 30 | 29 | 91.8 |

Data in Table III show that in a two-stage extraction process, the removal of Ni+V was greater when a chemical demetallization agent (DMPite) was present. At 900 psig, control runs 33–35 exhibited an average removal of Ni+V of 89.3 percent, at an average yield of 65.7 percent; whereas invention runs 36–39 exhibited an average removal of Ni+V of 93.8 percent, at a much higher average yield of 76.8 percent. At 950 psig, the removal of Ni+V in control run 40 was 80.4 percent at a yield of 79 percent, whereas the average removal of Ni+V in invention runs 41 and 42 was 89.8 percent, at an agerage extract yield of 79.5 percent.

EXAMPLE V

In this example, the demetallization of a different feed oil, Primrose crude residuum (boiling range: 650+° F.; containing about 116 ppm nickel and 375 ppm vanadium; having a Ramsbottom carbon residue of 13.9 weight percent and an API gravity at 60° F. of 7.0), by supercritical extraction with n-pentane, with and without added phosphorus compounds, is described. Pertinent process conditions and extract oil properties of representative runs are summarized in Table IV. The Primrose oil sample was produced from a heavy oil sands formation in Alberta, Canada.

TABLE IV

| Run | Pressure (psig) | Demetal-lizing Agent | Agent to Oil Wt Ratio | Extract Temp. (°F.) | Solvent to Oil Wt Ratio | Extract Oil Yield Wt % | Extract Oil Properties Rams. C Wt % | Extract Oil Properties ppm P | Extract Oil Properties ppm Ni | Extract Oil Properties ppm V | % Removal of Ni | % Removal of V |
|---|---|---|---|---|---|---|---|---|---|---|---|---|
| 43 (Control) | 900 | — | 0 | 400 | 4.43 | 72 | 4.9 | 29 | 24 | 73 | 85.1 | 86.0 |
| 44 (Control) | 900 | — | 0 | 408 | 4.23 | 72 | 5.5 | 25 | 28 | 87 | 82.6 | 83.3 |
| 45 (Invention) | 900 | DMPite | 0.004 | 405 | 4.17 | 72 | 4.3 | 187 | 21 | 54 | 87.0 | 89.6 |
| 46 (Invention) | 900 | DMPite | 0.017 | 405 | 4.29 | 67 | 3.6 | 787 | 19 | 29 | 89.0 | 94.8 |
| 47 (Invention) | 900 | DMPite | 0.038 | 405 | 4.21 | 72 | 4.2 | 1360 | 21 | 15 | 87.0 | 97.1 |
| 48 (Invention) | 900 | DMPite | 0.057 | 410 | 3.90 | 74 | 4.0 | 5480 | 16 | 5 | 89.8 | 99.0 |
| 49 (Invention) | 900 | DMPite | 0.059 | 397 | 4.12 | 74 | 4.9 | 1930 | 24 | 14 | 84.7 | 97.2 |
| 50 (Invention) | 900 | DMPite | 0.126 | 420 | 4.37 | 69 | 3.4 | 1500 | 14 | 1 | 91.7 | 99.8 |
| 51 (Invention) | 900 | DMPite | 0.242 | 410 | 4.03 | 71 | 3.8 | 1870 | 16 | 8 | 90.2 | 98.5 |
| 52 (Invention) | 900 | TEPite | 0.091 | 411 | 4.20 | 65 | 3.3 | 95 | 13 | 33 | 92.7 | 94.3 |
| 53 (Invention) | 900 | TEPite | 0.105 | 421 | 4.40 | 61 | 2.9 | 2525 | 11 | 7 | 94.2 | 98.9 |
| 54 (Control) | 950 | — | 0 | 395 | 4.23 | 71 | 5.0 | 39 | 24 | 74 | 85.3 | 86.0 |
| 55 (Control) | 950 | — | 0 | 389 | 4.07 | 76 | 5.9 | 32 | 31 | 95 | 79.7 | 80.7 |
| 56 (Control) | 900 | — | 0 | 418 | 3.55 | 62 | 4.4 | 74 | 19 | 48 | 89.8 | 92.1 |
| 57 (Control) | 950 | — | 0 | 401 | 4.25 | 72 | 4.8 | 21 | 24 | 71 | 85.1 | 86.4 |
| 58 (Invention) | 950 | DMPite | 0.014 | 395 | 4.33 | 77 | 5.3 | 250 | 29 | 86 | 80.8 | 82.3 |
| 59 | 950 | DMPite | 0.029 | 395 | 4.15 | 77 | 5.4 | 1680 | 29 | 43 | 80.8 | 91.2 |

TABLE IV-continued

| Run | Pressure (psig) | Demetallizing Agent | Agent to Oil Wt Ratio | Extract Temp. (°F.) | Solvent to Oil Wt Ratio | Extract Oil Yield Wt % | Extract Oil Properties Rams. C Wt % | ppm P | ppm Ni | ppm V | % Removal of Ni | % Removal of V |
|---|---|---|---|---|---|---|---|---|---|---|---|---|
| (Invention) 60[1] | 950 | DMPite | 0.052 | 395 | 4.36 | 70 | 6.6 | 1811 | 22 | 24 | 86.7 | 95.5 |
| (Invention) 61 | 950 | DMPite | 0.058 | 395 | 3.92 | 76 | 7.5 | 271 | 22 | 36 | 85.6 | 92.7 |
| (Invention) 62 | 950 | DMPite | 0.102 | 394 | 4.03 | 80 | 7.8 | 441 | 28 | 40 | 80.7 | 91.5 |
| (Invention) 63 | 950 | DMPite | 0.113 | 397 | 4.36 | 78 | 5.1 | 3170 | 25 | 14 | 83.2 | 97.1 |
| (Invention) 64 | 950 | DMPite | 0.219 | 393 | 4.04 | 82 | 6.4 | 4390 | 26 | 22 | 81.6 | 95.2 |
| (Invention) 65 | 950 | DMPite | 0.279 | 394 | 4.27 | 86 | 7.1 | 3520 | 38 | 19 | 71.8 | 95.6 |
| (Invention) 66 | 950 | TEPate | 0.049 | 395 | 4.07 | 75 | 5.4 | 38 | 29 | 87 | 81.3 | 82.6 |
| (Invention) 67 | 950 | TEPite | 0.093 | 395 | 4.04 | 79 | 5.5 | 4503 | 23 | 53 | 84.3 | 88.8 |
| (Invention) 68 | 950 | TEPite | 0.094 | 395 | 4.41 | 76 | 5.1 | 61 | 23 | 61 | 84.9 | 87.6 |

[1]DMPite was added to the solvent (before it was mixed with the oil) rather than added to the oil (as in all other runs).

Data in Table IV show that the organophosphorus demetallizing agents employed in the supercritical extraction of heavy oils were primarily effective in increasing the removal of vanadium, whereas the nickel removal was not significantly enhanced by these agents. This phenomenon was also observed for the examples using the Monagas residual feedstock. A comparison of Runs 60 and 61, as well as runs 64 and 65 shows that there was essentially no difference in metals removal when demetallizing agents were added to the solvent (before mixing with oil) rather than to the oil feed (before mixing with solvent).

Reasonable variations, such as those which would occur to a skilled artisan, can be made herein without departing from the scope of the invention.

We claim:

1. A process for treating and upgrading metal containing hydrocarbon feed streams comprising the steps of:

(a) contacting said feed in an extraction zone with at least one hydrocarbon solvent containing from 2 to 10 carbon atoms per molecule under supercritical separation conditions in the presence of at least one organophosphorus chemical demetallizing agent at an agent to hydrocarbon weight ratio and conditions sufficient to decompose or react with porphyrin and asphaltene compounds of metals present and thereby assist in the removal of metal contaminants from the hydrocarbon feed, and (b) recovering from said extraction zone an overhead stream comprising hydrocarbons substantially reduced in contaminating metals content and a bottoms product comprising solvent and contaminating metals.

2. The process of claim 1 wherein the carbonaceous feed is a high metals content oil and wherein the supercritical extraction is carried out at a temperature ranging from 200° F. to 900° F., a solvent oil weight ratio ranging from 1:1 to 10:1, a pressure ranging from 200 psig to 2000 psig, a residence time ranging from 0.5 minute to 60 minutes, and an extract:residue weight ratio ranging from 1:1 to 12:1.

3. The process of claim 2 wherein the demetallizing agent is added to the solvent before step (a).

4. The process of claim 2 wherein the solvent is selected from the group consisting of n-butane, isobutane, n-pentane, branched pentanes, n-hexane, branched hexanes, n-heptane, branched heptanes, and mixtures thereof; and the demetallizing agent is selected from the group consisting of trimethyl phosphate, triethyl phosphate, diphenyl phosphite, trimethyl phosphite, dimethyl phosphite, triethyl phosphite, and mixtures thereof.

5. The process of claim 2 wherein the demetallizing agent is added to the extraction zone at a point above the oil feed entry.

6. The process of claim 2 wherein the demetallizing agent is added to the oil feed stream before step (a).

7. The process of claim 6 wherein the mixture of demetallizing agent and oil feed stream is heat-soaked before step (a).

8. The process of claim 2 wherein the demetallizing agent is selected from the group consisting of hydrocarbylphosphines, hydrocarbyl phosphites, hydrocarbyl thiophosphites, hydrocarbyl phosphonates, hydrocarbyl phosphates, hydrocarbyl thiophosphates, hydrocarbylphosphine oxides, hydrocarbylphosphine sulfides, and mixtures thereof.

9. The process of claim 2 comprising the additional step of hydrodesulfurization of the product of step (a).

10. The process of claim 2 comprising the additional step (after step (a)) of recycling a portion of the bottoms product obtained in (b).

11. The process of claim 10 wherein the unrecycled bottoms portion is stripped for recovery of demetallizing agent and then oxidized to primarily CO and $H_2$.

12. The process of claim 1 wherein the solvent is selected from the group consisting of n-butane, isobutane, n-pentane, branched pentanes, n-hexane, branched hexanes, n-heptane, branched heptanes, and mixtures thereof.

13. The process of claim 12 wherein the demetallizing agent is selected from the group consisting of trimethyl phosphate, triethyl phosphate, diphenyl phosphite, trimethyl phosphite, triethyl phosphite, dimethyl phosphite, and mixtures thereof.

14. The process of claim 13 wherein the mixture of demetallizing agent and oil feed stream is heat-soaked before step (a).

15. The process of claim 14 wherein the heat-soak temperature is about 500°–700° F. and the heating time is 10–60 minutes.

16. The process of claim 15 wherein heat-soaking is carried out in the presence of hydrogen.

17. The process of claim 14 wherein the oil feed stream is the desolventized extract of the supercritical extraction of a heavy oil.

18. The process of claim 13 wherein the supercritical extraction is carried out at a temperature ranging from 200° F. to 900° F., a solvent oil weight ratio ranging from 1:1 to 10:1, a pressure ranging from 200 psig to 2000 psig, a residence time ranging from 0.5 minute to 60 minutes, and an extract:residue weight ratio ranging from 1:1 to 12:1.

19. The process of claim 13 comprising the additional step of catalytic cracking of the desolventized oil extract without prior removal of the demetallizing agent.

* * * * *